US005242076A

United States Patent [19]

Gibilisco

[11] Patent Number: 5,242,076

[45] Date of Patent: Sep. 7, 1993

[54] CHILD RESISTANT MEDICATION CONTAINER ASSEMBLAGE

[75] Inventor: Kenneth J. Gibilisco, Coopersburg, Pa.

[73] Assignee: Merck & Co., Inc., Rahway, N.J.

[21] Appl. No.: 977,352

[22] Filed: Nov. 17, 1992

Related U.S. Application Data

[63] Continuation-in-part of Ser. No. 776,916, Oct. 15, 1991.

[51] Int. Cl.[5] ..... B65D 85/00

[52] U.S. Cl. ..... 220/525; 220/346; 206/538

[58] Field of Search ..... 220/523, 525, 345, 346; 206/534.1, 536, 538

[56] References Cited

U.S. PATENT DOCUMENTS

| | | | |
|---|---|---|---|
| 2,378,003 | 6/1945 | Duell | 206/538 X |
| 2,383,367 | 4/1945 | Brown | 206/42 |
| 2,708,026 | 5/1955 | Duell | 220/345 X |
| 2,917,162 | 12/1959 | Horland | 206/42 |
| 3,033,355 | 5/1962 | Van Sickle | 206/42 |
| 3,782,584 | 1/1974 | Swenson et al. | 220/346 |
| 3,833,143 | 9/1974 | Starkermann et al. | 220/345 |
| 3,888,350 | 6/1975 | Horvath | 206/531 |
| 3,960,270 | 6/1976 | May | 220/523 X |
| 4,057,145 | 11/1977 | Wray et al. | 220/525 X |
| 4,126,224 | 11/1978 | Laauwe et al. | 206/540 |
| 4,817,819 | 4/1989 | Kelly | 221/2 |
| 4,919,264 | 4/1990 | Shinall | 220/523 X |
| 5,044,500 | 9/1991 | Webber et al. | 220/346 X |
| 5,080,222 | 1/1992 | McNary | 220/346 X |

FOREIGN PATENT DOCUMENTS

0447348A1 9/1991 European Pat. Off. .

*Primary Examiner*—Steven M. Pollard
*Attorney, Agent, or Firm*—Charles M. Caruso

[57] ABSTRACT

There is disclosed a child resistant medication container assemblage comprising a container base having a plurality of medication compartments formed therein to house unit doses of medication. The container base is provided with means to receive a slidably removable lid, means to prevent the lid from being returned to its normally closed position until a unit dose of medication has been removed and means coacting with catch means in the lid to resist efforts of children to access the medication.

7 Claims, 2 Drawing Sheets

CHILD RESISTANT MEDICATION CONTAINER ASSEMBLAGE

CROSS REFERENCE TO RELATED APPLICATION

This application is a continuation-in-part of U.S. application Ser. No. 776,916 filed Oct. 15, 1991.

BACKGROUND OF THE INVENTION

This invention relates to a novel child resistant medication container assemblage comprising a sliding lid, a compartmented container base having 1–3 rows of compartments capable of containing from 2–10 unit doses of medication such as tablets, capsules or desired substance in solid form per row, means to prevent the lid from being returned to its normally closed position until a unit dose of medication has been removed and means coacting with catch means in the lid to resist efforts of children to access the medication.

Various types of child resistant or safety containers have been developed which include a tray and a slidably engaging lid with the tray locked in the closed position using some type of locking mechanism. However, many of such containers are relatively complex in construction and operation, and typically require manual deformation of the lid and/or tray in order to release the locking mechanism prior to pulling open the tray. In addition, many of these pill and capsule containers, although child resistant, have proven to be inconvenient and cumbersome to operate for the users.

Typical child resistant bottle closures usually require the user to perform some preliminary manipulations before the bottle can be opened. For example, there are bottle closures that require the user to align a mark on the closure with a mark on the bottle in order to remove the closure (normally, a snap off cap). Other closures require the user to squeeze or pinch the closure while simultaneously rotating it to remove it. Still, other closures require the user to exert downward pressure on the closure and simultaneously rotate the closure in order to remove it from the battle.

Although such closures are effective, they require the exertion of some strength by the user. Many users, because of illness, manual deformation, manual flexibility limitations, and the like, either have difficulty in removing the closures or are unable to remove them at all. In addition, although such closures are touted as "child resistant", "tamper proof", and the like, observant and innovative children have been known to readily remove such closures.

SUMMARY OF THE INVENTION

This invention relates to a novel child resistant medication container assemblage that generally comprises: a container base having opposed end walls, opposed side walls, a plurality of medication compartments formed therein and means to slidably receive a closure lid; means within said medication compartments coacting with means on the lower, inner surface of said lid to prevent said lid from being returned to its normally closed position until a unit dose of medication is removed from said compartment; means within said medication compartments coacting with means on the lower, inner surface of said lid enabling said lid to be returned to its normally closed position after a unit dose of medication has been removed from said compartment; and, lock means at one end of said container coacting with lock means in said lid to resist access to the medication compartments by children.

The medication compartments are preferably formed in the container base in an offset and staggered relationship to one another enabling the unit doses of medication to be separately and sequentially accessed.

Compliance has always been a problem, especially with older patients. Medication is not taken on time or not at all and patients sometimes forget if and when they took their medication. The assemblage disclosed herein offers positive proof that medication has or has not been taken, and also offers a fool-proof mechanical means, since one cannot remove but one tablet/capsule at a time, and only in proper sequence.

The child resistant assemblage of the invention can be fabricated so that is easy to carry, opens to allow only one tablet, capsule or desired substance to be accessed prior to closing and automatically permits sequential access to the second, third and etc. medication compartments.

DETAILED DESCRIPTION OF THE INVENTION

The child resistant medication container of the invention will become more apparent from the ensuing description when considered together with the accompanying drawing wherein like reference numerals denote like parts and wherein.

Figure 1:
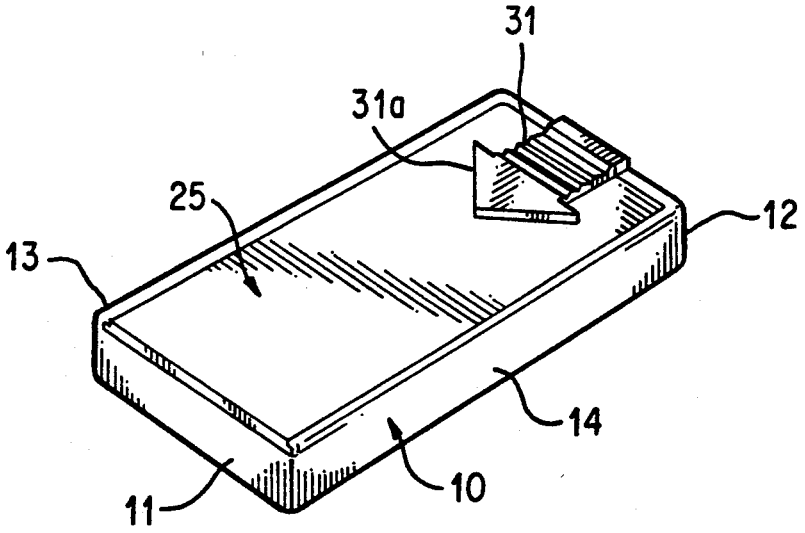
FIG. 1 is a perspective view of the child resistant medication container of the invention showing the lid in a closed position on the container base.
Figure 2:
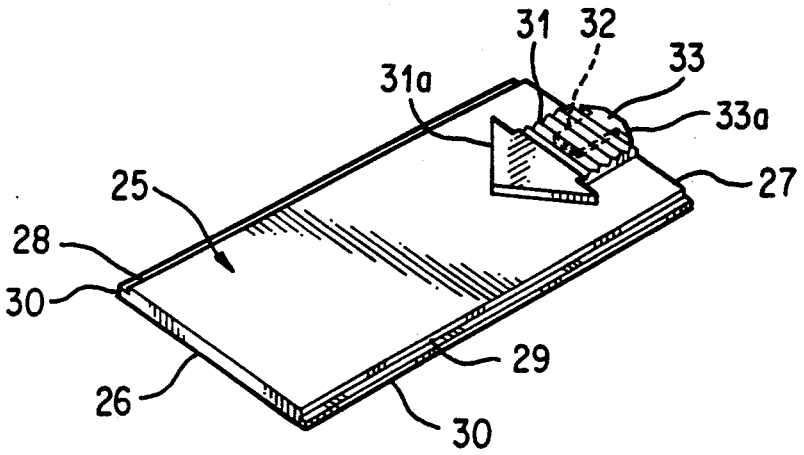
FIG. 2 is a perspective view of the container lid.
Figure 4:
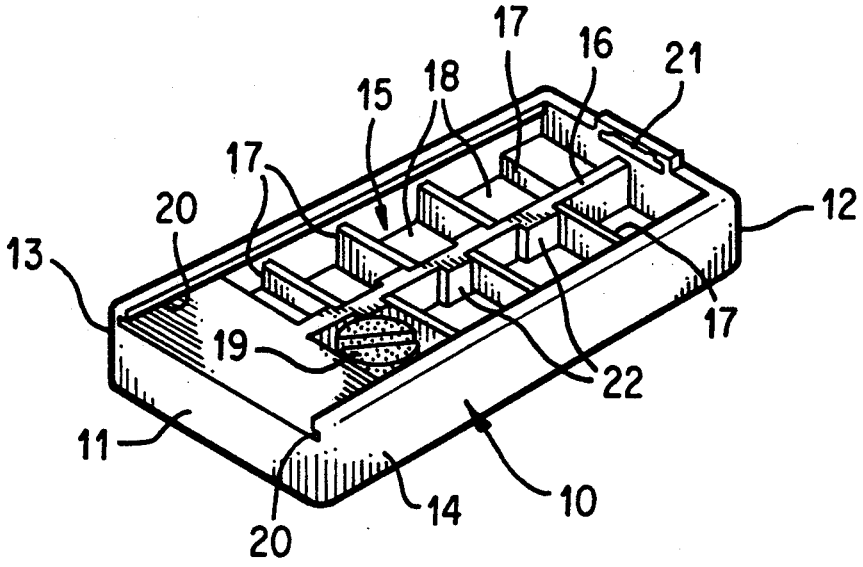
FIG. 4 is a perspective view of the container base.

As shown in FIGS. 1, 2 and 4, the child resistant medication container assemblage of the invention consists of a container base 10 and a lid 25. Container base 20 has opposed, vertical end walls 11, 12 and opposed, vertical side walls 13, 14 defining a container housing 15 therebetween (FIG. 4).

Within compartment housing 15 is a longitudinal, vertical divider wall 16 (FIG. 4) that extends between opposed end walls 11, 12 parallel to the longitudinal axis of the container base 10. In the embodiment shown, only one divider wall 16 is illustrated and it divides compartment housing longitudinally in half. However, it will be appreciated by those skilled in the art that several such divider walls can be provided.

As illustrated in FIG. 4., a plurality of vertical, transverse divider walls 17 that extend between side walls 13, 14 and longitudinal divider wall 16 are provided in container housing 15 so that longitudinal divider wall 16 and transverse divider walls 17 together define a plurality of medication compartments 18 in which unit doses of medication such as tablets, capsules or the like 19 can be placed. Preferably, divider walls 17 are offset with respect to each other so that the medication compartments 18 are arranged in staggered relationship with respect to one another.

A groove 20 (FIG. 4) is defined adjacent the upper ends of each of the side walls 13, 14 to slidably receive lid 25. Each groove 20 extends through one end wall such as 11 to but not through the opposed end wall such as 12. In the arrangement illustrated in FIG. 4, end wall 12 is fitted with a spring means 21 intermediate its ends and partially recessed in its upper edge. Spring means 21 is biased against slidably removable lid 25 when lid 25 is in its closed position helping to prevent lid 25 from being slid along grooves 20 as described in more detail hereinbelow.

Figure 5:
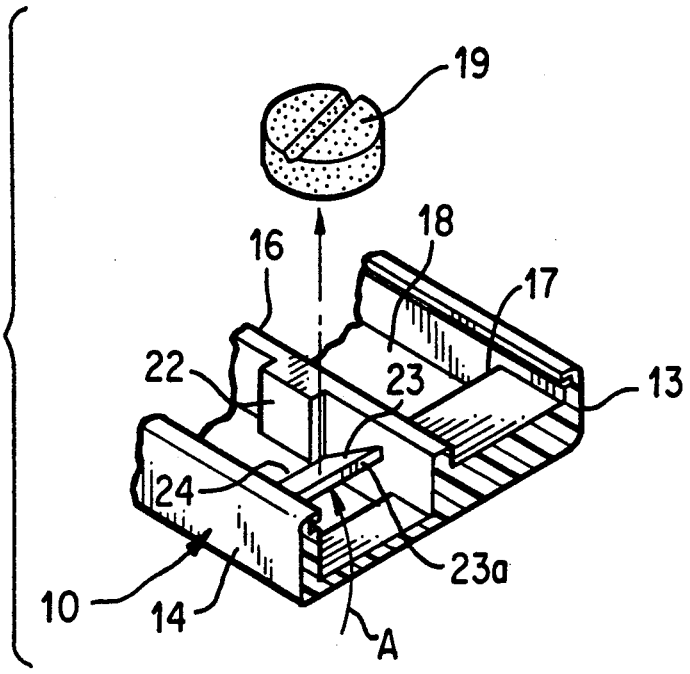
FIG. 5 is a perspective view of a fragmentary portion of the container base shown in FIG. 4.

As illustrated in FIGS. 4 and 5, each medication compartment 18 is provided with a vertical detent member 22 that protrudes into the compartment 18 from longitudinal diver wall 16. A portion of the floor 23 in each medication compartment 18 is hingeably secured by a spring hinge means 24 enabling the hinged floor 23 to rotate upwardly toward the open part of container housing 15 as indicated by arrow A in FIG. 5 after a unit case of medication has been removed. When fully rotated upwardly, the upper edges 23*a* of hinged floors 23 extend slightly above the upper ends of detents 22.

Figure 3:
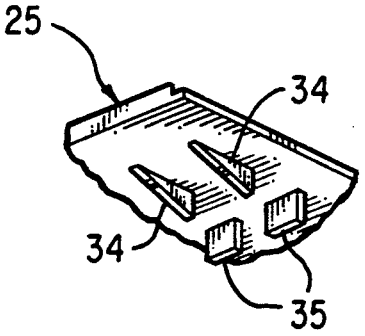
FIG. 3 is a perspective view of a fragmentary portion of the container lid shown in FIG. 2.

As illustrated in FIGS. 1, 2 and 3, slidably removable lid 25 has opposed end edges 26, 27 and opposed side edges 28, 29. Each of the side edges 28, 29 is provided with an outwardly protruding flange 30 (FIG. 2) which extend the entire length of side edges 28, 29 and are positioned intermediate their heights. Flanges 30 are slidably received in grooves 20 so that lid 25 overlies and closes the container housing 15.

The upper, outer surface of lid 25 that overlies spring means 21 is provided with a corrugated thumb grip 31 extending into the body of lid 25 and whose inner end can be in the form of an arrow 31*a* to indicate to the user the direction that lid 25 is to be moved when accessing the unit doses of medication. A slot 32 is formed within the body of thumb grip 31 to slidably receive and seat therein a catch member 33. The outer end of catch member 33 terminates in an angularly disposed leg 33*a* which engages spring means 21. Spring means 21 is biased upwardly against leg 33*a* and prevents lid 25 from being moved. In order to disengage leg 33*a* of catch member 33 from spring means 21, manual pressure is exerted downwardly on thumb grip 31 to depress spring means 21 and enable lid 25 to be slid in the direction of thumb grip arrow 31*a*.

As shown in FIG. 3, the lower, inner surface of lid 25 is provided with a plurality of spaced pairs of triangularly shaped, depending ramp members 34 and spaced pairs of depending stop members 35 spaced from but aligned with the bases of the triangular ramp members 34. Stop members 35 depend into container housing 15 an amount sufficient for them to engage the upper ends of detents 22 in the medication compartments 18.

If a unit dose of medication 19 is not removed from its medication compartment 18 after lid 25 has been slid along grooves 20 to expose the medication, lid 25 is prevented from being returned to its normally closed position by the engagement of stop members 35 with detents 22. However, when an exposed unit dose of medication is removed from its medication compartment 18, it permits hinged floor 23 to rotate upwardly (FIG. 5) with its upper edge 23*a* extending above detent 22. This enables the upper edge 23*a* to engage triangular ramps 34 and lift stop members 35 over detents 22 so that lid 25 can be slidably returned to its normally closed position.

With this assemblage, unit doses of medication can be readily accessed separately and sequentially by an adult while resisting accessing efforts of children.

It should be understood that the drawings are not necessarily to scale and that the embodiments are sometimes illustrated by graphic symbols, phantom line, diagrammatic representations and fragmentary views. In certain instances, details which are not necessary for an understanding of the present invention or which render other details difficult to perceive may have been omitted. It should be further understood, of course, that the invention is not necessarily limited to the particular embodiments illustrated herein.

In practicing the concepts of this invention, the overall dimensions of the device disclosed herein are not critical and can range from 1 to 15 inches, width to length, respectively; preferably from 1 to 8 inches. Also, the size of the medication for delivery is not critical. However, as one skilled in the art can readily appreciate, the device disclosed herein is designed for child safety in combination with ease in administering daily or prescribed medication. If so desired, the date and/or number for each medicament can be inscribed on the slidable lid, thereby being useful to the elderly or patient having memory disorders.

What is claimed is:

1. A child resistant medication container assemblage comprising (a) a container base and a closure lid;

(b) said container base having opposed vertical end walls, opposed vertical side walls, a plurality of medication compartments formed therein each of which can contain a unit dose of medication and means to slidably receive said closure lid;

(c) means within each of said medication compartments coacting with means on said closure lid to prevent said closure lid from being returned to its normally closed position until a unit dose of medication has been removed from a medication compartment;

(d) means within each of said medication compartments coacting with means on said closure lid enabling said closure lid to be returned to its normally closed position after a unit dose of medication has been removed from a medication compartment;

(e) lock means at one end of said container base coacting with lock means in said closure lid to resist access to said medication compartments by children; and, (f) said closure lid having an upper outer surface, a lower inner surface, opposed end edges and opposed side edges, each of said side edges having an outwardly protruding flange that extends along the lengths of each of said side edges.

2. The child resistant medication container assemblage of claim 1 wherein said plurality of medication compartments are offset with respect to each other and are arranged in a staggered relationship with respect to one another such that said unit doses of medication are separately and sequentially accessed.

3. The child resistant medication container assemblage of claim 1 wherein each of said opposed side walls of said container base has a groove defined therein to slidably receive said outwardly protruding flanges of said closure lid, said groove being adjacent the upper end of each of said side walls and extending through one end wall of said compartment base to the opposed end wall of said compartment base.

4. The child resistant medication container assemblage of claim 1 wherein said coacting means within said medication compartments and on said closure lid that prevent said closure lid from being returned to its normally closed position comprise a vertical detent member within each of said medication compartments and at least one pair of stop members depending from the lower inner surface of said closure lid an amount sufficient to engage the upper ends of said detent members.

5. The child resistant medication container assemblage of claim 4 wherein said coacting means with said medication compartments and on said closure lid that enable said closure lid to be returned to its normally closed position comprise hinge means in the floor of each of said medication compartments that permit a portion of said floor to rotate upwardly after a unit dose of medication has been removed therefrom and at least one pair of triangularly shaped ramp members depending from the lower inner surface of said closure lid an amount sufficient to engage the upper edges of said rotated floors such that said stop members become disengaged from said vertical detent members enabling said closure lid to be returned to its normally closed position.

6. The child resistant medication container assemblage of claim 1 wherein said coacting lock means comprises a spring member partially recessed in an upper edge of one of said end walls of said container base and a catch member slidably seated in said closure lid at that end of said closure lid that overlies said spring member when said closure lid is in its normally closed position.

7. The child resistant medication container assemblage of claim 6 wherein the upper outer surface of said closure lid at that end overlaying said catch member has formed therein a corrugated thumb grip to facilitate sliding said closure lid to open and normally closed positions and to indicate to a user that area on said closure lid where downward pressure is to be exerted to disengage said coacting lock means.

* * * * *